US007771285B2

(12) United States Patent
Porter

(10) Patent No.: US 7,771,285 B2
(45) Date of Patent: Aug. 10, 2010

(54) GOLF CLUB

(76) Inventor: Warren J. Porter, 2/16 Cuthbertson Street, Moulden NT 0630 (AU)

( * ) Notice: Subject to any disclaimer, the term of this patent is extended or adjusted under 35 U.S.C. 154(b) by 0 days.

(21) Appl. No.: 11/916,137

(22) PCT Filed: May 31, 2006

(86) PCT No.: PCT/AU2006/000722

§ 371 (c)(1),
(2), (4) Date: Nov. 30, 2007

(87) PCT Pub. No.: WO2006/128222

PCT Pub. Date: Dec. 7, 2006

(65) Prior Publication Data

US 2008/0207348 A1 Aug. 28, 2008

(30) Foreign Application Priority Data

May 31, 2005 (AU) ..... 2005902789

(51) Int. Cl.
*A63B 69/36* (2006.01)
*A63B 53/04* (2006.01)

(52) U.S. Cl. ..... 473/236; 473/251; 473/252; 473/340; 473/341; 473/349

(58) Field of Classification Search ..... 473/324–350, 473/219–256, 282–292, 257, 265
See application file for complete search history.

(56) References Cited

U.S. PATENT DOCUMENTS 3,039,776 A 6/1962 Faini
3,194,564 A 7/1965 Swan
D222,889 S * 1/1972 Dziurgot ..... D21/745
D226,526 S * 3/1973 Cicero ..... D21/741
3,966,210 A * 6/1976 Rozmus ..... 473/341
4,130,282 A 12/1978 Pelz
4,323,246 A 4/1982 Nehrbas
4,650,191 A * 3/1987 Mills ..... 473/341
4,741,535 A * 5/1988 Leonhardt ..... 473/252
4,846,477 A * 7/1989 Phelan ..... 473/330
4,871,174 A * 10/1989 Kobayashi ..... 473/252
4,986,544 A * 1/1991 Benson ..... 473/254
5,011,153 A 4/1991 Watkins
5,135,229 A 8/1992 Archer
5,441,268 A * 8/1995 Shier ..... 473/236
5,924,935 A 7/1999 Prewitt
6,634,956 B1 * 10/2003 Pegg ..... 473/251
6,827,655 B2 * 12/2004 Burns ..... 473/236
6,872,149 B1 3/2005 Devon
D532,845 S * 11/2006 Rollinson ..... D21/736
7,247,102 B2 * 7/2007 Hayd ..... 473/236

(Continued)

FOREIGN PATENT DOCUMENTS

GB 2 399 027 9/2004

*Primary Examiner*—Sebastiano Passaniti
(74) *Attorney, Agent, or Firm*—Davis & Bujold, P.L.L.C.

(57) ABSTRACT

A golf club head having a body and a strike face for striking a golf ball. The strike face is arranged at the front of the body, and a projection projecting forwardly of the body at one side of the strike face. In use, the projection extends in the same direction as a strike direction of the strike face. The golf club head further comprises an alignment marking which extends along an upper surface of the projection.

17 Claims, 4 Drawing Sheets

U.S. PATENT DOCUMENTS 7,322,891 B1 * 1/2008 Prewitt ..... 473/236
7,393,285 B2 * 7/2008 Stellander ..... 473/251
7,396,288 B2 * 7/2008 McLauhglin ..... 473/236
D591,371 S * 4/2009 Hilton ..... D21/736
2002/0151374 A1 10/2002 Imamura
2005/0020372 A1 * 1/2005 Hermle et al. ..... 473/242
2006/0030419 A1 * 2/2006 Koster ..... 473/236

* cited by examiner

Figure 1
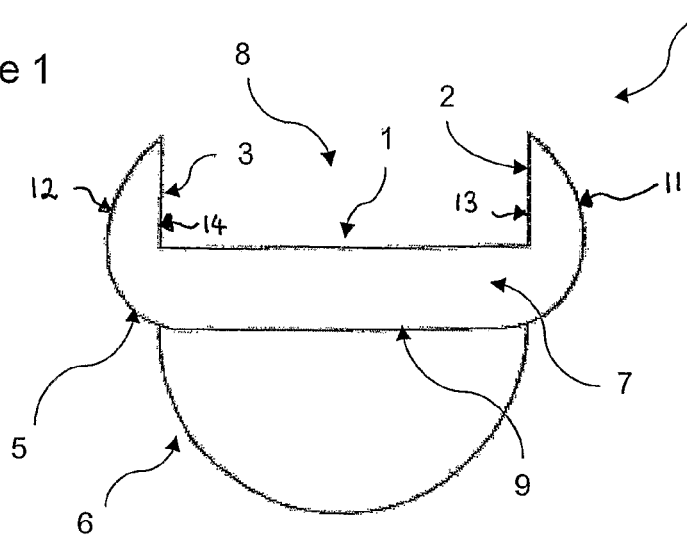
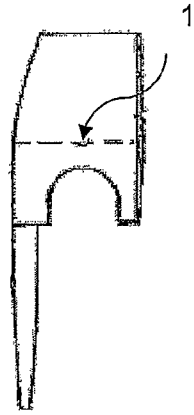
Figure 2
Figure 3
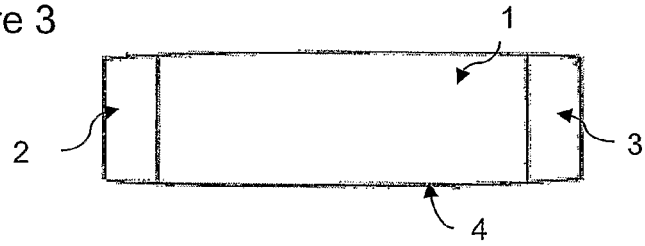
Figure 4
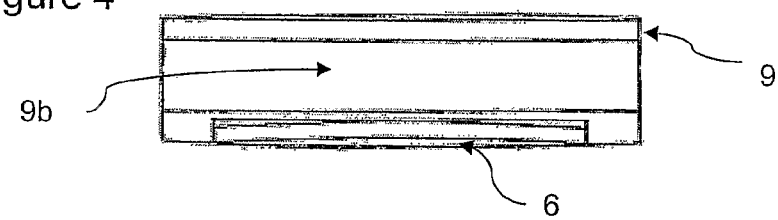
Figure 5
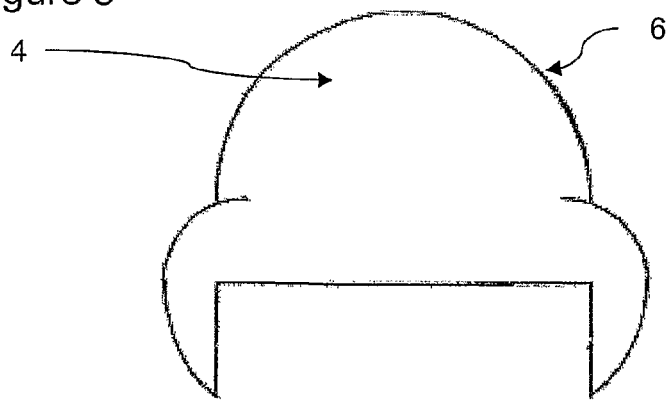
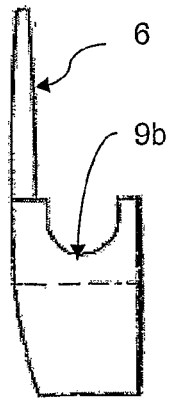
Figure 6

Figure 7
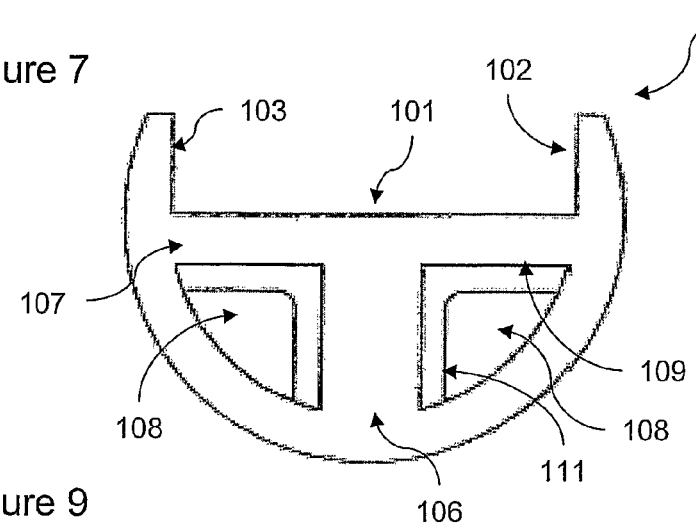
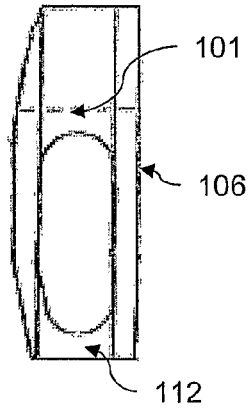
Figure 8
Figure 9
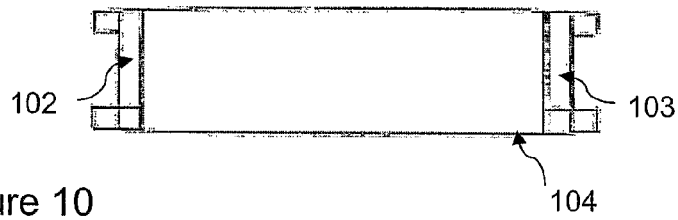
Figure 10
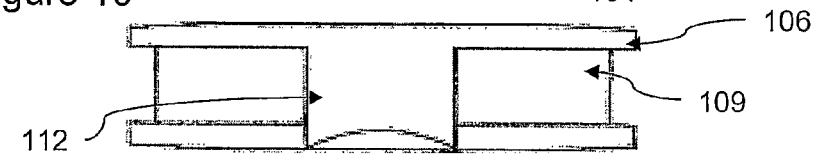
Figure 11
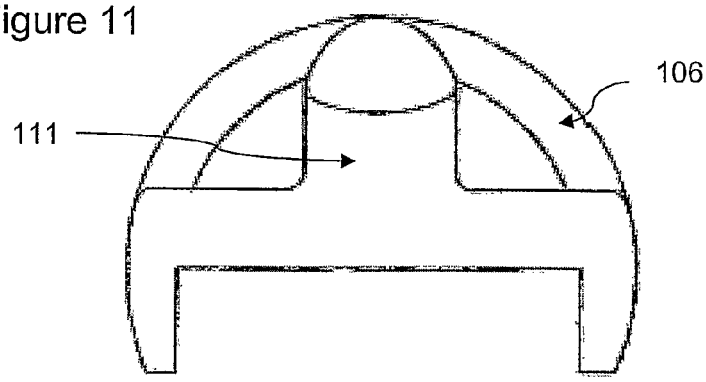
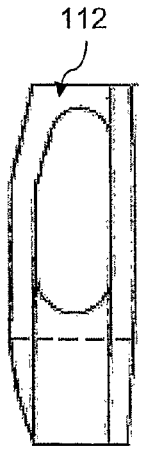
Figure 12

GOLF CLUB

This is a national stage completion of PCT/AU2006/000722 filed May 31, 2006 and claims priority from Australian Application Serial No. 2005902789 filed 31 May 2005.

TECHNICAL FIELD

The present invention relates to a golf club, and, particularly, but not exclusively, to a golf putter.

BACKGROUND

Modern putters may provide alignment markings disposed thereon for assisting the golfer in determining the alignment of the putter head when lining up a putt.

In an ideal putting motion, the strike face of the putter head will contact the ball at an angle orthogonal to that of the determined putting line. This ensures that the ball travel is in the intended direction.

Alignment markings are generally arranged on the upper surface of the putter head so that the golfer can inspect the putter head alignment while holding the putter in a typical fashion. The markings are usually defined along a centre line extending across the surface of the putter head. The aforementioned alignment markings provide a limited indication of the strike face alignment.

It may be advantageous if assistance to a golfer could be improved.

SUMMARY OF THE INVENTION

In accordance with a first aspect, the present invention provides a golf club head having a body and a strike face for striking a golf ball, the strike face being arranged at the front of the body, and a projection projecting forwardly of the body at one side of the strike face, in use the projection extending in the same direction as a strike direction of the strike face; wherein the golf club head further comprises an alignment marking which extends along an upper surface of the projection.

In a preferred embodiment, the projection extends orthogonally to the strike face.

The strike direction will generally be orthogonal to the face of the golf club head (i.e. in the same direction as the extending projection). It is preferably an advantage of an embodiment of the invention, that the projection, being directed in the same direction as a golf player is to play their shot, assists the golf player in aligning their shot.

In an embodiment, a further projection is provided extending forwardly of the body at the other side of the strike face, whereby the projection and the further projection form a pair of projections which together with the strike face form a recess which, in use, receives the ball when aligning the club head for a golf shot.

The further projection may also extend orthogonally to the strike face.

In an embodiment, an outside face of each projection curves inwardly towards an inside face of the respective projection as the projections extend forwardly of the body. In one embodiment, the outside face meets the inside face at a point. In an embodiment the inside face extends away from the strike face in a plane orthogonal thereto.

In an embodiment, the projections are located at either end of the strike face.

In an alternative embodiment, the projections are located inwardly of each end of the strike face and located sufficiently apart to receive the ball.

In an embodiment, the alignment marking may extend orthogonally to the strike face. Where there are a pair of projections, alignment markings may extend along the upper surface of both projections, preferably orthogonally to the strike face. A further alignment marking may extend along the upper surface of the golf club head parallel to the strike face. The parallel extending marking may join the marking(s) extending along the projection(s). The markings advantageously assist in ball alignment. The alignment markings may also be used to indicate the "sweet spot" of the strike face, or for indicating the part of the strike face which is most balanced, for further aiding the player in making the shot. In an embodiment, the alignment marking(s) extend substantially parallel and proximal to the inside face of the projection(s). In an embodiment, the alignment making(s) extend substantially parallel to and away from an inside face of the projection(s). In an embodiment, the further alignment marking is located proximal to the strike face. In an embodiment the further alignment marking is spaced away from the strike face. The alignment marking(s) may be coloured.

The projection may include a bottom surface that tapers upwards as the projection extends from the body.

In an embodiment, the body includes a rear aft mass extending from the back of the body. The rear aft mass may comprise a counter balance.

In an embodiment the rear aft mass is semi circular. In an alternative embodiment the rear aft mass is generally rectangular.

In an embodiment, a rear face of the body may include a recess extending a predetermined depth into the body.

BRIEF DESCRIPTION OF THE DRAWINGS

Features and advantages of the present invention will become apparent from the following description of an embodiment thereof, by way of example only, with reference to the accompanying drawings, in which:

FIG. 1 is a top view of a putter head according to a first embodiment of the present invention;

FIG. 2 is a left side view of the putter head of FIG. 1;

FIG. 3 is a front view of the putter head of FIG. 1;

FIG. 4 is a rear view of the putter head of FIG. 1;

FIG. 5 is a bottom view of the putter head of FIG. 1;

FIG. 6 is a right side view of the putter head of FIG. 1;

FIG. 7 is a top view of a putter head according to a second embodiment of the present invention;

FIG. 8 is a left side view of the putter head of FIG. 7;

FIG. 9 is a front view of the putter head of FIG. 7;

FIG. 10 is a rear view of the putter head of FIG. 7;

FIG. 11 is a bottom view of the putter head of FIG. 7;

FIG. 12 is a right side view of the putter head of FIG. 7;

DETAILED DESCRIPTION OF PREFERRED EMBODIMENTS

Figure 13:
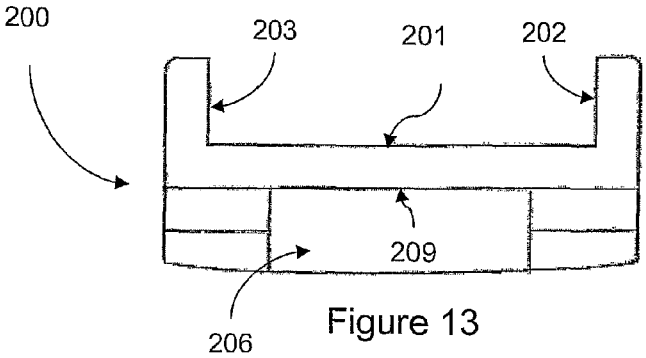
FIG. 13 is a top view of a putter head according to a third embodiment of the present invention.
Figure 14:
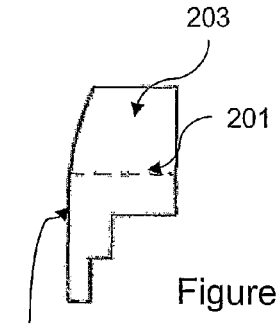
FIG. 14 is a left side view of the putter head of FIG. 13.
Figure 15:
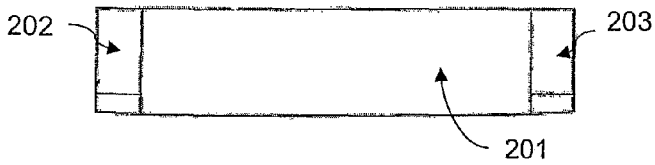
FIG. 15 is a front view of the putter head of FIG. 13.
Figure 16:
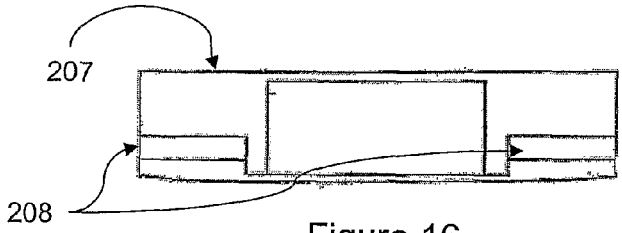
FIG. 16 is a rear view of the putter head of FIG. 13.
Figure 17:
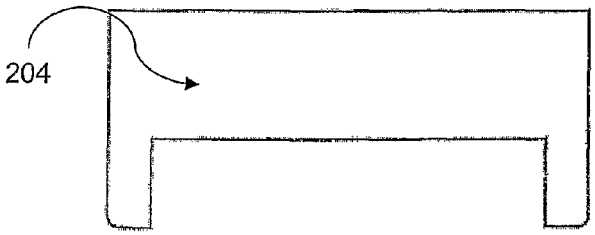
FIG. 17 is a bottom view of the putter head of FIG. 13.
Figure 18:
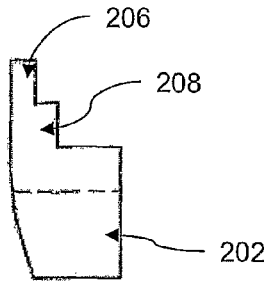
FIG. 18 is a right side view of the putter head of FIG. 13.

With reference to FIGS. 1 to 6, a golf putter head in accordance with the first embodiment of the present invention will now be described. The golf putter head 10 includes a strike face 1, in use arranged to strike a golf ball, and at least one projection 2, 3 extending, in this embodiment, substantially orthogonally in relation to the strike face 1. The projection 2, 3, acts as an alignment aid to assist a golfer operating the putter to align their golf shot when striking a golf ball.

In more detail, in this embodiment, the head 10 includes a body 5 and first 2 and second 3 alignment projections extending from the body 5. A rear aft mass 6 extends rearwardly of the body 5.

The alignment projections 2 and 3 extend forward of the strike face 1 at either side (toe and heel) thereof. In this embodiment, projections 2 and 3 are arranged orthogonally to the front face 1, and mirror each other about an axis that extends through the longitudinal mid-point of the strike face and orthogonal thereto. This arrangement may be referred to as the 'leaf effect'. According to this embodiment, an outer face 11, 12 of the alignment projections 2 and 3 curves inwardly towards an inner face 13, 14 of the projection 2 and 3 and meets at a point.

The alignment projections 2, 3 and strike face 1 form between them a recess 8, in which to receive the golf ball when lining up the putt. The aforementioned configuration provides an improved visual indication of the direction of the strike face 1 with respect to a golf ball situated therein. The projections 2 and 3 are deliberately biased forward of the strike face 1 to emphasise the alignment thereof, such that, upon contact with the ball, the golfer is more likely to have aligned the strike face 1 in a direction perpendicular to that of the intended putting line. Further, it should be noted that the spacing between the alignment projections is in no way limited to the particular arrangement which is depicted in the drawings. The spacing may be narrower or wider.

In the first embodiment, the projections 2 and 3 are biased forward of the front face by approximately 10 mm to 25 mm, however the projections may be longer or shorter depending on the golfer's individual preference.

In the embodiment described above, the rear aft mass 6 is shaped substantially in the form of a semi-circle depending from the rear face 9 of the putter body 5. The rear aft mass 6 extends behind the rear face 9 of the body 6 in substantially the same plane as the sole 4 of the putting head 10.

Rear face 9 also includes a recessed part 9*b* extending a predetermined depth into the body 5 of the head 10. In this embodiment, a depth of 10 mm is realised, however the depth may be more or less depending on the desired 'sweet spot' and putter weight. The recess is cut out in the form of a semi-circle, however any number of shapes could be realised.

A second embodiment of the present invention is described with reference to FIGS. 7 to 12. In this embodiment, the strike face 101 and the projections 102, 103 are configured in a similar configuration to that of the first embodiment. However, the aft mass comprises a top aft mass 106 and a sole aft mass 111. The top aft mass 106 extends behind the rear face 109 in substantially the same plane as the upper face 107, while the sole aft mass 111 extends behind the rear face 109 in substantially the same plane as the sole 104 of the putter head 100. The sole aft mass 111 further provides a support pillar 112, providing support for the top aft mass 106 seated thereon. The sole aft mass 111 can be further configured to taper upward as it extends away from the sole 104.

In the second embodiment, cut out portions 108 are also defined in the upper surface of the top aft mass 106 to affect the weight and balance of the putter head 100.

A third embodiment of the present invention is described with reference to FIGS. 13 to 18. The strike face 201 and projections 202, 203 are arranged in a configuration similar to that of the first embodiment. In this embodiment, however, a substantially rectangular rear aft mass 206 depends from a rear face 209 of the head 200. In this embodiment the rear aft mass 206 depends behind the rear face 209 in substantially the same plane as the sole 204 of the putting head 200.

In the third embodiment, the rear aft mass 209 comprises one or more counter balance weights 208 disposed thereon. The counter balance weights 208 are arranged strategically on both longitudinal peripheries of the rear aft mass 209 to affect the overall balance and weight of the putting head 200.

Figure 19:
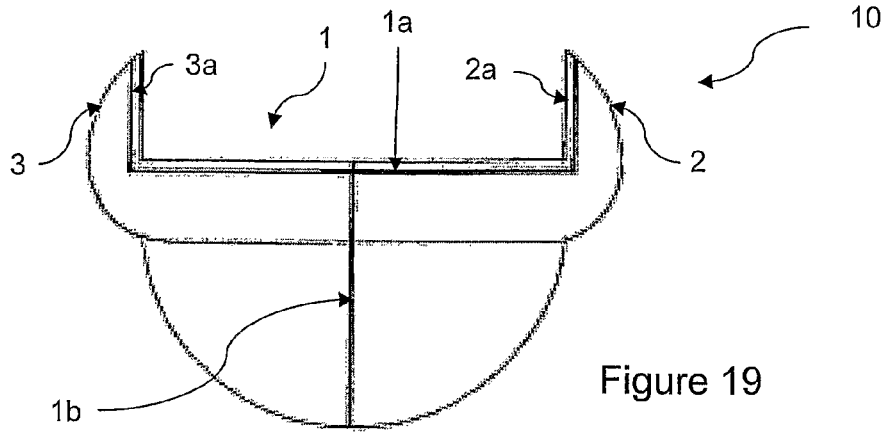
FIG. 19 is a top view of a putter head according to a fourth embodiment of the present invention.
Figure 20:
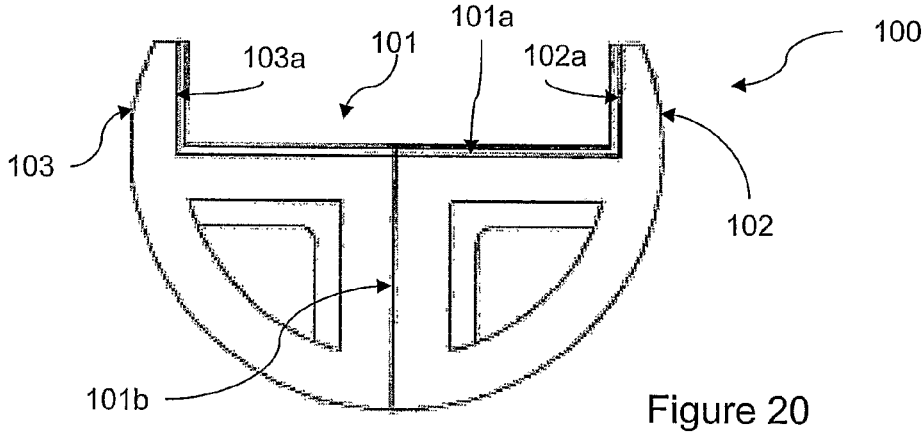
FIG. 20 is a top view of a putter head according to a fifth embodiment of the present invention.
Figure 21:
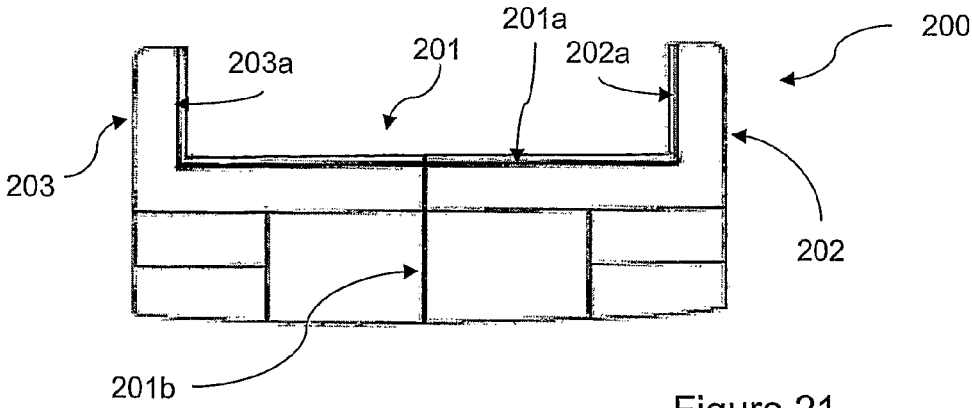
FIG. 21 is a top view of a putting head according to a sixth embodiment of the present invention.

A fourth, fifth and sixth embodiment are now described by way of reference to FIGS. 19, 20 & 21. In these embodiments the putter heads 10, 100, 200 are further arranged to provide alignment markings 1*a*, 1*b*, 2*a*, 3*a*, 101*a*, 101*b*, 102*a*, 103*a*, 201*a*, 201*b*, 202*a*, 203*a* disposed on the upper surfaces thereof. These markings further aid the golfer in determining the direction of the putter when lining up the put. In the fourth embodiment, alignment markings 1*b*, 101*b*, 201*b* are arranged to define the latitudinal centre of the putter head 10, 100, 200. In the fifth embodiment, alignment markings 1*a*, 2*a*, 3*a*, 101*a*, 102*a*, 103*a*, 201*a*, 202*a*, 203*a* also extend along the inner circumference of the recess defined by the alignment projections 2, 3, 102, 103, 202, 203 and front faces 1, 101, 201.

The alignment markings 1*a*, 2*a*, 3*a*, 101*a*, 102*a*, 103*a*, 201*a*, 202*a*, 203*a* may be either line markings, or defined groves as shown in FIGS. 19 to 21. The alignment markings 1*a*, 2*a*, 3*a*, 101*a*, 102*a*, 103*a*, 201*a*, 202*a*, 203*a* in combination with projections 2, 3, 102, 103, 202, 203 are provided to assist the golfer in determining the most suitable alignment of the putter head for making the golfing shot; while alignment markings 1*b*, 101*b*, 201*b* are provided to indicate the "sweet spot" of the putter heads 10, 100, 200. The alignment markings may be represented using any type of colour scheme. The depicted alignment markings 1*a*, 2*a*, 3*a*, 101*a*, 102*a*, 103*a*, 201*a*, 202*a*, 203*a* are located proximal to an inside face of the projections and strike face. In an alternative embodiment, the alignment markings may be located away from the inside face and strike face.

The above described embodiments relate specifically to a golf putter. It will be understood that the present invention may be applied to other golf clubs. For example, it may be applied to a golf driver club.

In the above-described embodiment, the golf club head includes two projections, one at either end of the strike face. The invention is not limited to a club having two projections. A single projection, for example, may still provide some alignment assistance.

In the above-described embodiments, it will be appreciated the means may be provided, and will generally be provided, to enable securement of a golf club shaft to the golf club head.

Finally, it is to be appreciated that various alterations or additions may be made to the parts previously described without departing from the spirit or ambit of the present invention.

The claims defining the invention are as follows:

1. A golf club head having a body and a strike face for striking a golf ball, the strike face being arranged at a front of the body, an aft mass including a counter balance extending rearwardly from a rear face, the rear face opposing the strike face and including a recess extending a predetermined depth into the body, and a pair of projections, each projection extending forwardly of the body at one side of the strike face and orthogonally thereto, in use the projections forming a recess which receives the golf ball when aligning the club head for a shot;

wherein the golf club head further comprises alignment markings which extend along an upper surface of each projection, and each projection includes a bottom surface which curves upwardly from a point immediately adjacent the strike face.

2. The golf club head according to claim 1, wherein an outside face of each projection curves inwardly towards an inside face of the respective projection as the projections extend forwardly of the body.

3. The golf club head according to claim 2, wherein the outside face meets the inside face at a point.

4. The golf club head according to claim 2, wherein the inside face extends in a plane orthogonal to the strike face.

5. The golf club head according to claim 1, wherein the projections are located inwardly of each end of the strike face and located sufficiently apart to receive the ball.

6. The golf club head according to claim 1, wherein at least one of the alignment markings extends orthogonally to the strike face.

7. The golf club head according to claim 1, wherein at least one of the alignment markings extends substantially parallel and proximal to an inside face of at least one of the projections.

8. The golf club head according to claim 1, wherein at least one of the alignment markings extend substantially parallel to and away from an inside face of at least one of the projections.

9. The golf club head according to claim 1, comprising a further alignment marking extending along the upper surface of the golf club head parallel to the strike face.

10. The golf club head according to claim 9, wherein the further alignment marking is located proximal to the strike face.

11. The golf club head according to claim 9, wherein the further alignment marking is spaced away from the strike face.

12. The golf club head according to claim 9, wherein the further alignment marking joins the alignment markings extending along at least one of the projections.

13. The golf club head according to claim 1, wherein at least one of the alignment marking and further alignment marking are colored.

14. The golf club head according to claim 1, wherein the rear aft mass is semi circular.

15. The golf club head according to claim 1, wherein the rear aft mass is generally rectangular.

16. A golf club head having a body and a strike face for striking a golf ball, the strike face being arranged at a front of the body, an aft mass including a counter balance extending rearwardly from a rear face, the rear face opposing the strike face and including a recess extending a predetermined depth into the body, and a pair of projections, each projection extending forwardly of the body at one side of the strike face and orthogonally thereto, in use the projections forming a recess which receives the golf ball when aligning the club head for a shot;

wherein the golf club head further comprises at least one alignment marking which extends along an upper surface of each projection, the alignment markings extend substantially parallel to and away from an inside face of the projections, and each projection includes a bottom surface which curves upwardly from a point immediately adjacent the strike face.

17. A golf club head having a body and a strike face for striking a golf ball, the strike face being arranged at a front of the body, an aft mass including a counter balance extending rearwardly from a rear face, the rear face opposes the strike face and includes a recess extending a predetermined depth into the body, and a pair of projections, each projection extending forwardly of the body at one side of the strike face and orthogonally thereto, in use the projections forming a recess which receives the golf ball when aligning the club head for a shot;

wherein the golf club head further comprises at least one alignment marking which extends along an upper surface of each projection, the alignment marking extends substantially parallel to and away from an inside face of the projections, and each projection includes a bottom surface which curves upwardly from a point immediately adjacent the strike face.

* * * * *